United States Patent [19]

Bogucki-Land

[11] Patent Number: 5,060,881

[45] Date of Patent: Oct. 29, 1991

[54] PROCESS FOR THE WINDING OF WARP BEAMS

[75] Inventor: Bogdan Bogucki-Land, Offenbach, Fed. Rep. of Germany

[73] Assignee: Karl Mayer Textilmaschienfabrik GmbH, Obertshausen, Fed. Rep. of Germany

[21] Appl. No.: 506,679

[22] Filed: Apr. 9, 1990

[30] Foreign Application Priority Data

Apr. 24, 1989 [DE] Fed. Rep. of Germany ..... 3913381

[51] Int. Cl.[5] ..... B65H 23/198

[52] U.S. Cl. ..... 242/75.51; 28/194

[58] Field of Search ..... 242/75.51, 75.52, 75.45, 242/75.47, 186, 187; 28/185, 190, 194, 196, 197

[56] References Cited

U.S. PATENT DOCUMENTS

| | | | |
|---|---|---|---|
| 2,283,036 | 5/1942 | Bohn | 242/75.52 |
| 3,595,492 | 7/1971 | Furst | 242/75.51 |
| 3,780,961 | 12/1973 | Kahwati et al. | 242/75.51 X |
| 3,810,589 | 5/1974 | Mousseau | 242/75.51 X |
| 3,858,820 | 1/1975 | Crouse | 242/75.51 X |
| 3,862,723 | 1/1975 | Bonikowski | 242/75.51 X |
| 4,513,790 | 4/1985 | Sainen et al. | 242/75.51 X |
| 4,528,631 | 7/1985 | Bogucki-Land | 28/190 |
| 4,977,466 | 12/1990 | Nakata | 242/186 |

FOREIGN PATENT DOCUMENTS

| | | | |
|---|---|---|---|
| 54-141952 | 5/1979 | Japan | 242/75.45 |

*Primary Examiner*—John M. Jillions
*Attorney, Agent, or Firm*—Omri M. Behr

[57] ABSTRACT

A process for the continual comparison of the actual-value relationship with the target-value relationship of the wound diameter of a warp beam and the number of revolutions executed by said beam, said values being continually transmitted. There is also provided a warping arrangement for the foregoing procedure in which the warp sheet path to the driven warp beam is provided with a turning roller, and comprises a measuring arrangement for transmitting the warp beam diameter and a rotation counter. The object of the invention being to provide in a simple manner, a number similarly wound beams. Thus, without the intermediation of a thread tension measuring means, the difference between the actual-value relationship and the target-value relationship is continually evened out by control of the feed speed of the thread sheet that the driven turning roller is provided with a slip-preventing circumferential surface.

15 Claims, 1 Drawing Sheet

PROCESS FOR THE WINDING OF WARP BEAMS

BACKGROUND OF THE INVENTION

The invention comprises a process for comparing the actual-value relationship and the predetermined target-value relationship between the effective warp beam diameter and the revolutions executed by said driven beam, which information is provided repeatedly. Furthermore, the invention is directed to a warping arrangement in which the thread sheet path to the driven warp beam runs over a turning roller. The warping arrangement also is equipped with a measuring arrangement for the determination of the effective warp beam diameter as well as a rotation counter.

In the winding of beams, particularly with cotton or other natural fibers, different influences such as thread tension, humidity, temperature, and twist (even with the application of constant tension) cause different warp thicknesses, that is to say, different warp beam diameters. This is particularly disturbing in the formation of partial warp beams that are later wound off on a common axis. The differences in the tension in the unwinding thread sheet, because of different diameters in the partial warp beam, lead to the formation of warp streaks in the goods. When differently wound partial warp beasm are assembled on a warping arrangement, substantial amounts of thread sheet are often left on individual partial warp beams when the first partial warp beam has been unwound.

In a known arrangement (direct warping apparatus Series DS 42/40 MC of Applicant's assignee) the thread warp tension is measured. The warp diameter occurring after a predetermined number of revolutions is compared with a predetermined target-value and the target-value of the thread sheet tension is altered where deviations from the actual beam diameter from the target diameter occur. The thread sheet tesnion is determined by a roller aggregation that is located between the creel and a slub detector. Thereafter, the thread sheet runs through an oiling arrangement and a thread storage means till it reaches the turning roller on the beam upon which it is to be warped.

SUMMARY OF THE INVENTION

It is an object of the present invention to provide a simple process, whereby a plurality of similarly wound beams can be produced. An object of this invention is obtained in that, without measuring the tension in the thread sheet, the difference between the actual-relationship and the target-relationship can be equalized by control of the feed speed of the thread sheet.

In the process of the present invention therefore, no measurement of thread tension is necessary, which simplifies the construction and further facilitates the processing of the data produced.

The desired tension adjusts itself quite sufficiently by itself, when the relationship of the rotation rate with the diameter are maintained at a present condition enables the even winding of a plurality of partial warp beams. This is particularly advantageous in the assembly in a plurality of partial warp beams in a warping arrangement or in the warping of partial warp beams on a winding arrangement. It has been shown that for the production of satisfactory woven or warped goods it is not necessary to have an absolutely constant thread tension during takeoff where all the partial warp beams are equally wound. That is to say, the partial warp beams have been equally wound with respect to each other, then during takeoff the partial warp beams have sufficiently equal tension to produce the desired product.

Input speed of the thread sheet can thus be controlled by a passive means that applies more or less braking force to the thread sheet. In a particularly advantageous embodiment, the thread sheet is driven by a controllable drive means located upstream of the beam that determines the input speed. This preserves the thread sheet to a considerable extent, since it must not constantly operate against a braking force. Furthermore, the thread sheet is generally driven by a drive whose drive speed is temporarily lowered when the warp diameter threatens to become too large.

In a further preferred embodiment, the control of the input speed is implemented shortly before the warp beam, it being preferred that this distance is less than double the maximum warp beam diameter. In modern beam arrangements the thread sheet is taken off at a speed exceeding 1000 meters per minute. To maintain the actual beam diameter in conformity with the target beam diameter, it is thus necessary to institute frequent control measures, that is to say, speed changes. The more frequently these controls are activated the closer will be the conformity of the actual diameter to the target diameter. Every periodic change in speed however, carries with it the danger that at a particular frequency, the thread sheet will vibrate between the beam and the point where the speed change occurs. The critical frequency, that is to say, the frequency at which this particular thread segment resonates is dependent upon the length of the thread sheet in this segment. The shorter the segment the higher can be the frequency of control activation, without raising the danger of resonance. The higher the activation frequency chosen, the better will be the winding on the beam. It has been found particularly advantageous if this segment shall be smaller than double the maximum of the warp beam diameter. In this case, the length of the segment varies between double (in the unwound beam) and $1\frac{1}{2}$ times with the fully wound beam.

It is advantageous if the target-relationship between the beam diameter and the number of rotations is linear. Such a linear relationship is easy to measure and supervise.

In a particularly preferred embodiment, the target-relationship can be determined from the relationship on a previously wound master beam between the number of revolutions and the beam diameter. This process ensures that all following beams have the same relationship between the number of revolutions and the beam diameter as in the master beam. If such a row of partial warp beams is used in a warping arrangement, it is possible to produce very even warped or woven goods.

Basically, it is possible, in the winding of the master beam to measure repeatedly the desired beam diameter at predetermined numbers of revolutions and store the thus achieved results. It is however, simpler to develop the target-relationship current number of revolutions and the inner diameter, the outer diameter and the total number of revolutions of a previously wound beam. This is particularly simple, in the case of a linear relationship between the number of revolutions and the beam diameter. Smaller variations which could have occurred in the winding of the master beam are then not transferred to a later wound partial warp beam.

It is further the object of the present invention to construct an arrangement that enables the easy provision of similarly wound beams.

This task can be achieved utilizing an arrangement of the prior art in which the turning roller is driven and in its working area, has an upper surface that substantially prevents slippage relative to the thread sheet.

Thus, the turning roller serves as a speed influencing arrangement for the thread sheet. The upper surface of the turning roller is so constituted that it substantially prevents slippage between the turning roller and the thread sheet in the working area. Therefore, in a change between two preset speeds (and two preset thread tensions), the speed of the driven rollers is, for all intents and purposes, absolutely transferred to the thread sheet. This enables relatively exact control of the speed of the thread sheet without exercising the particularly strong force thereon.

At the same time, it is not desirable to totally eliminate slippage. To maintain a beam diameter in a desired relationship with a predetermined number of revolutions, there may be provided a control arrangement that compares the actual relationship (calculated from the beam diameter and the number of revolutions) with the predetermined target relationship. Upon deviation of the actual from the target relationship, the control arrangement alters the drive speed of the turning rollers. By this simple feedback, a small slippage during the transfer of speed from the turning roller to the thread sheet is evened off. The main advantage of the control lies in that the beam can be wound with a direct relationship between the diameter and the number of revolutions.

It is further advantageous, to provide that the thread sheet path is free of further rollers for measuring thread tension or effecting other controls. On the one hand, this free region avoids interference with the control of the winding speed and on the other hand, considerably simplifies the construction of the arrangements. In order to introduce a reliable thread tension measuring arrangement, a relatively complex construction must be provided that ensures that the thread sheet exercises a particular force on the measuring means, without however, raising the thread tension itself. By avoiding the need to measure the thread tension, the present invention avoids the need for such an arrangement.

It is advantageous that the turning angle at the turning roller is greater than 90°. This makes it possible for the turning roller of the present invention to achieve an adequate contact between the roller and the thread sheet, in order to regulate sheet speed with the roller in a slip free manner.

It is further desirable, that the turning angle however, shall be less than 180°. In this manner, it is not necessary to take any extraordinary measures to prevent too great a proximity between the segment of the threads running into and away from the turning roller. Furthermore, no additional turning rollers are necessary. The turning roller can be provided above and, in the thread warping direction, behind the beam in order to obtain a desired turning angle.

It is further desirable for the control arrangement to comprise a microprocessor. Controls operated by a microprocessor are easy to change and adapt to the desired parameters.

It is further advantageous to provide that the means for measuring the diameter of the beam be provided as a contactless measuring device. This preserves the thread sheet and at the same time, enables an accurate measurement of the thread diameter, without influencing either the speed or the tension of the thread sheet.

BRIEF DESCRIPTION OF THE DRAWINGS

The invention may be illustrated in the preferred embodiments in conjunction with the drawings that show.

DETAILED DESCRIPTION OF THE DRAWINGS

Figure 1:
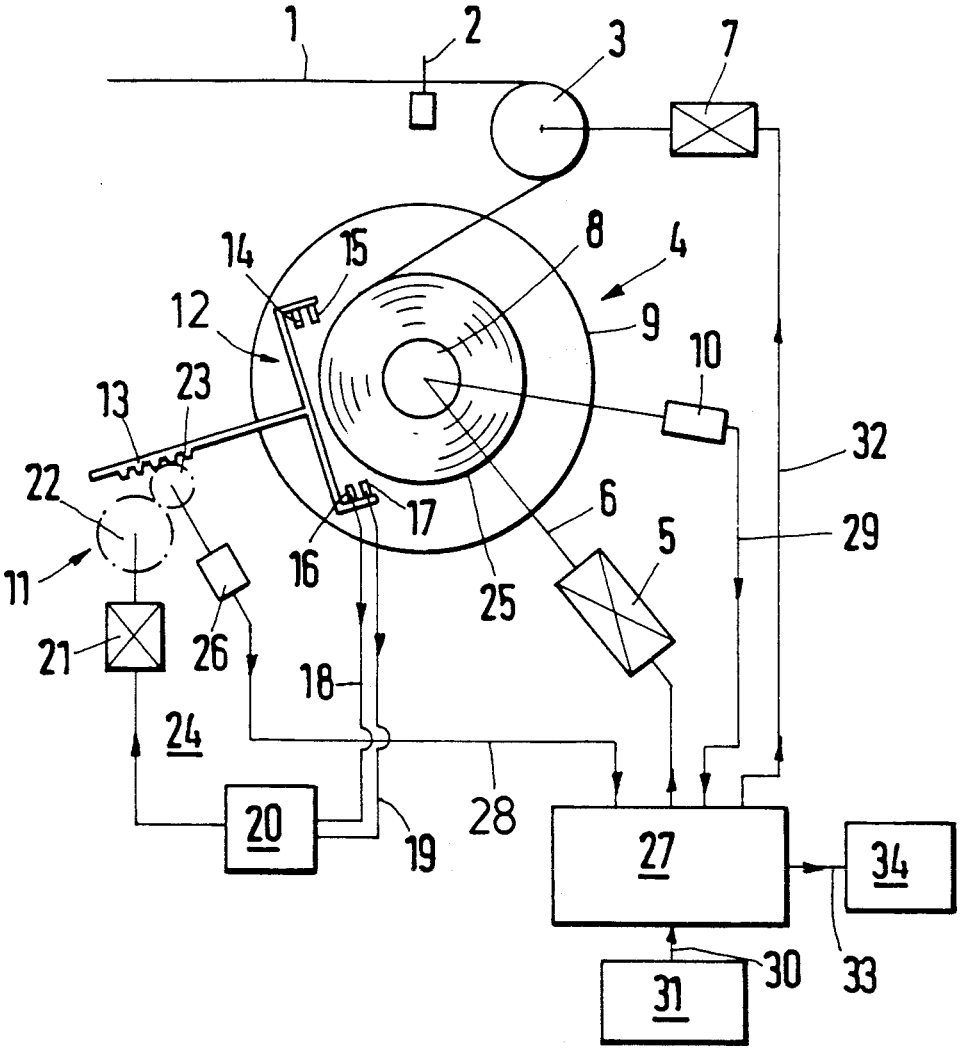
FIG. 1 is a schematic side elevational view of the construction of the beam arrangement.

A thread sheet 1 is led to the warp beam 4 via a main reed 2 and a turning roller 3, which is driven by motor 5 about axis 6 to wind said thread sheet 1. The turning roller 3 is driven by turning roller motor 7 and has a rough circumferential surface which substantially prevents slippage between the thread sheet and said circumferential surface. The circumferential surface of roller 3 can be coated with rubber or an elastic sheath in order to increase the braking force between it and thread sheet 1. The warp beam 4 comprises a core 8 which determines the minimum diameter $D_1$ and two side flanges 9 which determine the maximum diameter Da. A revolution counter 10 transmits the number of revolutions which the warp beam has executed in a predetermined time interval. In its simplest form, axis 6 is provided with a peg which, upon each revolution of warp beam 4, increases the value of the counter by the value of one. This permits an exact tracking of the total revolutions executed by beam 4. An even more accurate determination of the position of the beam in the course of a single rotation can be made if a pattern is traced on axis 6, which can be detected by counter 10.

A diameter measuring means 11 comprises a measuring head 12 on a racked rod 13. The measuring head comprises two optical senders 14 and 15 and two receivers 16 and 17. Both the senders 14 and 15 and the receiver 16 and 17 are oriented one behind the other, in a direction perpendicular to the axis of rotation of the beam in which direction the racked rod 13 is also moveable. Both senders 14 and 15 project a light beam, suitably, an infrared beam, which runs perpendicular to the direction of movement of the racked rod 13 and is received by the appropriate receivers 16 and 17.

The output signals of the receivers 16 and 17 run over leads 18 and 19 to comparator 20. This comparator 20 sends a signal to motor 21 which can adjust the position of racked rod 13 via two gear wheels 22 and 23, so that the beam running between sender 15 and receiver 17 is continually interrupted and the beam between sender 14 and receiver 16 is similarly not interrupted.

In this way, control circuit 24 ensures that the measuring head 12 is always held a predetermined distance from warp 25. Motor 21 can, for example, be a stepping motor which is activated by pulses generated by control unit 20. A pulse generator 26 is connected to gear wheel 23 to produce an encoded electrical signal, in accordance with the angular displacement generated by the change of position of the racked rod 13. Of course, it is also possible to evaluate the pulse fed to motor 21 in this way to obtain an electrical signal corresponding to the diameter of warp 25.

The arrangement further comprises a control arrangement 27 to which the information from pulse generator 26 runs over lead 28 carrying information about the diameter of warp 25. Similarly, information from the revolution counter 10 concerning the revolutions of beam 4 is transmitted over lead 29. The control arrangement 27 is connected to an input arrangement 31 via lead 30 over which the desired relationship between the diameter and the revolution count can be dispatched. The input arrangement 31 can be a key pad but it can also be a reading arrangement for a digital or analog data bank, such as magnetic tapes or diskettes by which a larger amount of data can be dispatched to the control arrangement 27 to permit a more complex relationship to be established between the desired values of the number of revolutions and the diameter of the beam for the wound-up beam 4.

The control arrangement 27 comprises a micro processor which calculates the current actual relationship between the diameter and revolution count information supplied from leads 28 and 29, and compares these calculated values with the predetermined target-values. Both relationships can for example, be expressed in the form of a function. When a difference occurs between the two functions, that is to say, when the predetermined diameter as corresponding to a predetermined number of revolutions, does not coincide with the actual diameter, the control arrangement 27 sends a signal over line 32 to turning roller motor 7. Thereafter the rate of revolution of the turning roller motor 3 is raised or lowered. When the actual diameter is too small, the rate of rotation of the turning roller is raised and when the diameter of the beam is too great, the number of revolutions of the turning roller is reduced. Thus, generally speaking, only very brief changes in speed are required.

A control arrangement 27 is connected, via a further output lead 33 to an output arrangement 34 which, at predetermined points, for example, 2,000, 4,000, 6,000, etc., reads out the status of the beam diameter and the number of revolutions. This output arrangement 34 can be a simple display, and it can also be connected with a printer or a recording input for a data recordation device. This is particularly advantageous when the winding arrangement is utilized for the formation of a so-called master beam, that is to say, the first partial warp beam of a row of warp beams which are unwound on a common axis or, assembled together, to be used as a warping arrangement. The function curve for the relationship between the diameter and the number of rotations can be written to a data recording means via output arrangement 34, and can be utilized in a later production run for further warp beams as input for the control arrangement via input arrangement 31.

For the production of a master beam, it is sufficient to provide the starting diameter, the desired final diameter and the appropriate number of revolutions to the input arrangement 31. The control arrangement 27 can thus readily extrapolate the desired diameter of the warp 25, in accordance with the following formula:

$$D_{target}=(D_a-D_i)n^*/N$$

wherein $D_i$ is the internal diameter of the beam 4, (that is to say, the diameter of the core 8), $D_a$ is the desired outer diameter of the finished beam, N is the number of revolutions to be carried $n^*$ is the number of revolutions already carried, out to this point and $D_{target}$ is the desired diameter of the warp after $n^*$ revolutions are carried out.

Figure 2:
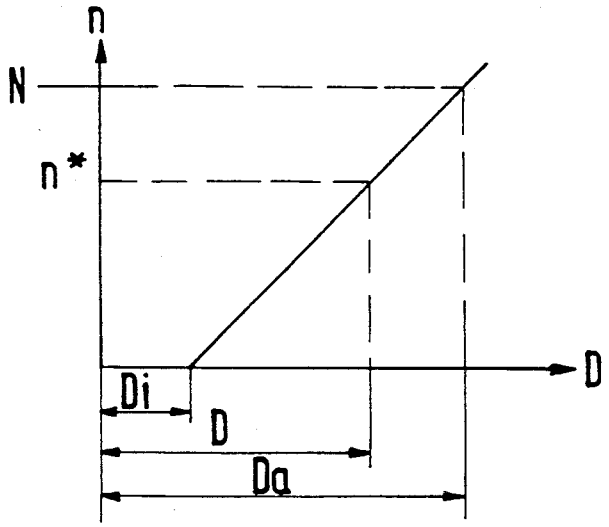
FIG. 2 is a graph showing the relationship between the number of revolutions (y axis) and the diameter of the beam (x axis).

FIG. 2 shows this relation graphically. This sort of determination of the desired diameter by extrapolation can of course, also be utilized for the production of further partial warp beams.

Boundary measurement signals can also be provided which send notification when the difference between the circumferential speed of the driven turning rollers and that of the beam become too large. Then an appropriate signal, for example, an acoustic signal, can be generated which warns of the violation of a boundary value, specifically, an unacceptably high value of slippage. The boundary value can be set to be about plus or minus 5% of the circumferential speed of the beam.

I claim:

1. A process for warping a thread sheet onto a warp beam while maintaining a predetermined target relationship between the number of turns and the outside diameter of the thread sheet on the warp beam, comprising the steps of:

measuring the values of the diameter of the thread sheet wound on the warp beam; and counting the executed revolutions of the warp beam;

repeatedly comparing the predetermined target relationship to the current, actual-value relationship between the number of turns and the outside diameter of the thread sheet on the warp beam; and changing the input speed of the thread sheet in a direction to compensate for the difference between the current, actual-value relationship and the predetermined target relationship without measurement of the tension in said thread sheet.

2. A process according to claim 1, wherein the input speed of the thread sheet is controlled by a drive means located upstream of the warp beam.

3. A process according to claim 2, wherein the changing of the input speed of the thread sheet is performed at a location proximate to the warp beam.

4. A process according to claim 3, wherein the changing of the input speed is performed at a location separated from the warp beam by a distance smaller than twice the maximum warp beam diameter.

5. A process in accordance with claim 1, wherein the predetermined target relationship between the beam diameter and the number of rotations executed by the beam is linear.

6. A process in accordance with claim 5, wherein that said predetermined target relationship is determined from a previously wound beam.

7. A process in accordance with claim 6, characterized thereby that the target-value for the warp beam diameter of a wound beam is determined from the values for the momentary number of revolutions executed, the internal diameter, the external diameter, and the total number of revolutions of a previously wound beam.

8. A beam warping arrangement for winding a thread sheet onto a beam comprising:

means for mounting and rotating a warp beam;

a warp beam measuring arrangement for measuring the diameter of the wind on the beam and providing a wind signal signifying the diameter of the wind;

a counter for counting the revolutions executed by the beam and for providing a count signal;

a turning roller located on the path of said thread sheet (upstream) of said beam, the circumferential surface of said roller being provided with a slip resistant surface;

means for driving said roller; and means coupled to said counter and said warp beam measuring arrangement for controlling the rate of rotation of said turning roller in response to said count signal and said wind signal.

9. An arrangement in accordance with claim 8, further comprising:

a control arrangement for comparing the current relationship between the wind signal and the count signal with a predetermined target-value relationship and in accordance with deviations between said current and said target-value relationships alter the drive speed of the turning roller.

10. An arrangement in accordance with claim 9, wherein the thread sheet path is free of thread tension measuring means.

11. An arrangement in accordance with claim 10, wherein the thread sheet path is free of thread tension measuring means.

12. An arrangement in accordance with claim 10, wherein the turning angle of the thread sheet of the turning roller is greater than 90°.

13. An arrangement in accordance with claim 12, wherein the turning angle of the thread sheet at turning roller is less than 180°.

14. An arrangement in accordance with claim 9, wherein the control arrangement comprises a microprocessor.

15. An arrangement in accordance with claim 8, wherein the warp beam measuring arrangement comprises a contact-less measuring arrangement.

* * * * *